United States Patent [19]

Taube

[11] Patent Number: 4,459,910

[45] Date of Patent: Jul. 17, 1984

[54] EMBOSSING MACHINE WITH INDEXING MECHANISM

[75] Inventor: William L. Taube, Torrance, Calif.

[73] Assignee: Metal Box Can, Inc., Torrance, Calif.

[21] Appl. No.: 429,664

[22] Filed: Sep. 30, 1982

[51] Int. Cl.[3] ..... B41J 1/46

[52] U.S. Cl. ..... 101/18; 101/43; 101/79; 101/85

[58] Field of Search ..... 101/18, 3 R, 42, 43, 101/78, 79, 84, 85

[56] References Cited

U.S. PATENT DOCUMENTS

| | | | |
|---|---|---|---|
| 583,878 | 6/1897 | Hocke | 101/78 X |
| 793,396 | 6/1905 | Rodriguez | 101/79 |
| 3,120,800 | 2/1964 | Ward | 101/85 X |
| 3,310,810 | 3/1967 | Greissman | 101/79 X |
| 4,314,505 | 2/1982 | Krembel, Jr. | 101/18 X |

FOREIGN PATENT DOCUMENTS

| | | | |
|---|---|---|---|
| 62515 | 2/1949 | Netherlands | 101/18 |
| 1411501 | 10/1975 | United Kingdom | 101/18 |

*Primary Examiner*—Clifford D. Crowder

*Attorney, Agent, or Firm*—Diller, Ramik & Wight

[57] ABSTRACT

This disclosure relates to an embossing machine having an indexing mechanism including an indexing wheel carrying a plurality of embossing stamps which are individually rotated into association with an opposing anvil during relative opening motion between a pair of die elements thereby indexing a different embossing stamp to its embossing position and applying different codes to the material passing through the embossing machine, the indexing mechanism further including a spring-biased arm carrying an indexing detent for yieldably holding the indexing wheel in one of a plurality of desired positions, and a pivotally mounted pawl acting against pins of the indexing wheel to rotate the latter and release the indexing detent between successive embossing operations.

41 Claims, 6 Drawing Figures

EMBOSSING MACHINE WITH INDEXING MECHANISM

Soft drink manufacturers are actively promoting their products by sales promotion "games", and these are "played" by lifting and opening the tab on a can of beverage and looking under it for a winning "code". Since no equipment existed at the plant of the can manufacturer for placing this code or similar information on or under the tab, the present embossing machine or press was developed to apply different codes successively to tabs so that when these were applied to cans, the eventual consumer could lift, open and inspect the tab to determine if he has won a particular game by virtue of the code imprinted on the tab.

Since most consumable can beverages are packaged and sold at the retail level in six-packs or eight-packs, the present embossing machine carries ten different nonwinning codes on ten individual embossing stamps which in ten cycles of the die elements imprint each of the ten codes individually on ten tabs. (Winning codes are put in a special die which is run under strict security controls to ensure that no winning codes are stolen and to prevent excessive winning codes from being produced.) However, insofar as nonwinning codes are concerned, since ten consecutive codes are applied to successively produced tabs, it is more likely than not that a six-pack or an eight pack will have different codes thereon which is desirable from a psychological standpoint since this would indicate to the consumer that though he may not have won a particular game, he has at least "lost" the game through a number of different loosing codes rather than the same loosing code. In any event, the invention is directed specifically to the indexing mechanism for bringing a different one of ten successive embossing stamps carrying the different codes to an embossing or printing position during each cycle of the embossing machine.

In keeping with the foregoing, a primary object of this invention is to provide a novel embossing machine which includes a conventional pair of die elements mounted for reciprocal motion between a first generally opened position and a second generally closed position, one of the die elements carrying a rotatable shaft which in turn carries a number of embossing stamps, a wheel carried by the shaft for indexing each embossing stamp successively into alignment with an opposing anvil means normally though releasably holding the indexing wheel in one of a plurality of distinct positions during the embossing operation, and means for rotating the indexing wheel in response to relative movement of the die elements toward the first generally opened position thereof to position successive ones of the embossing stamps into continuing cooperative relationship with the anvil for repetitious embossing of tabs moving through the embossing machine.

A further object of this invention is to provide a novel embossing machine of the type latter-noted wherein the means for rotating the indexing wheel includes a pivotal pawl, a plurality of angularly spaced abutment pins carried by the indexing wheel which are individually and successively engaged by the pawl, and a spring for normally urging the pawl into engagement with the indexing wheel pin.

Yet another object of this invention is to provide a novel embossing machine of the type latter-noted wherein the holding means for the indexing wheel includes an arm carrying an indexing detent and the indexing wheel includes a number of recesses adapted to receive the indexing detent, thereby holding the indexing wheel and the associated embossing stamps aligned with associated anvils during an embossing or printing operation.

With the above and other objects in view that will hereinafter appear, the nature of the invention will be more clearly understood by reference to the following detailed description, the appended claims and the several views illustrated in the accompanying drawings.

IN THE DRAWINGS

FIG. 3 is an end view of the embossing machine of FIG. 2, and illustrates further details of the embossing machine including a take-off drive from the tab press for relatively reciprocating the embossing machine die elements.

Figure 1:
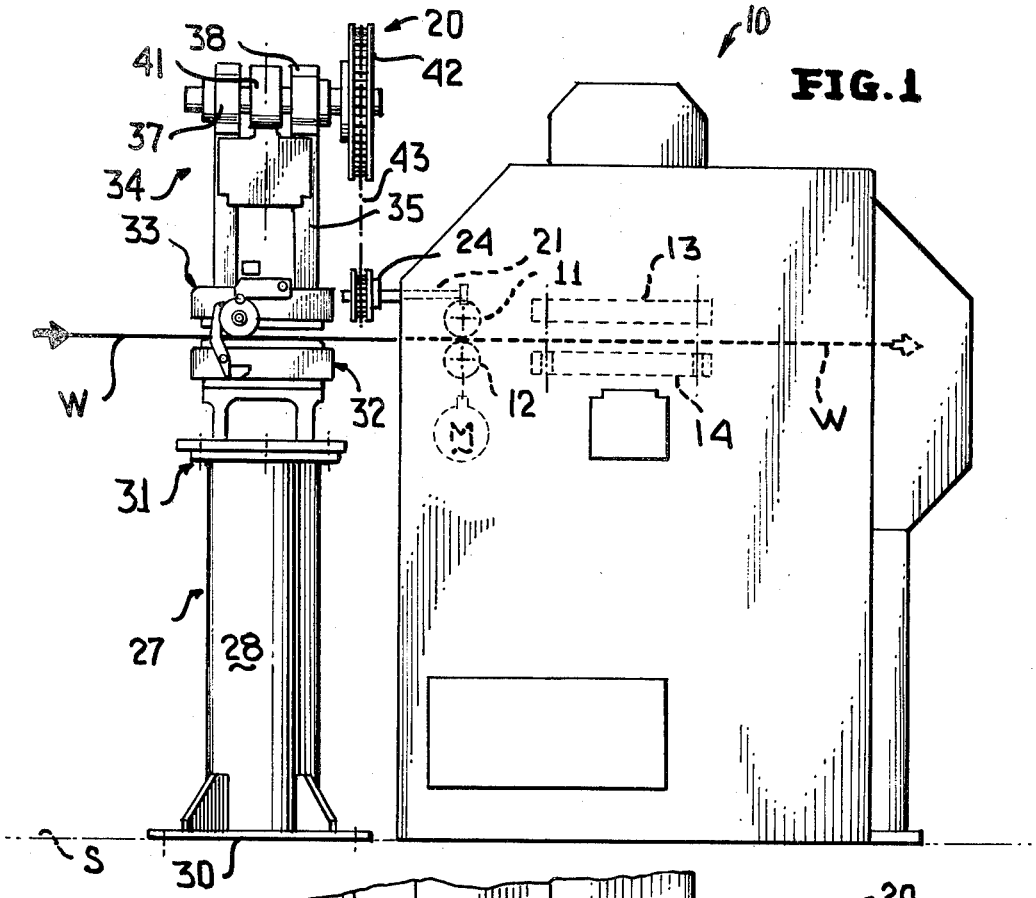
FIG. 1 is a schematic side elevational view of a conventional tab press which forms beverage or can tabs, and associated therewith is an embossing machine of the present invention including its associated indexing mechanism.
Figure 2:
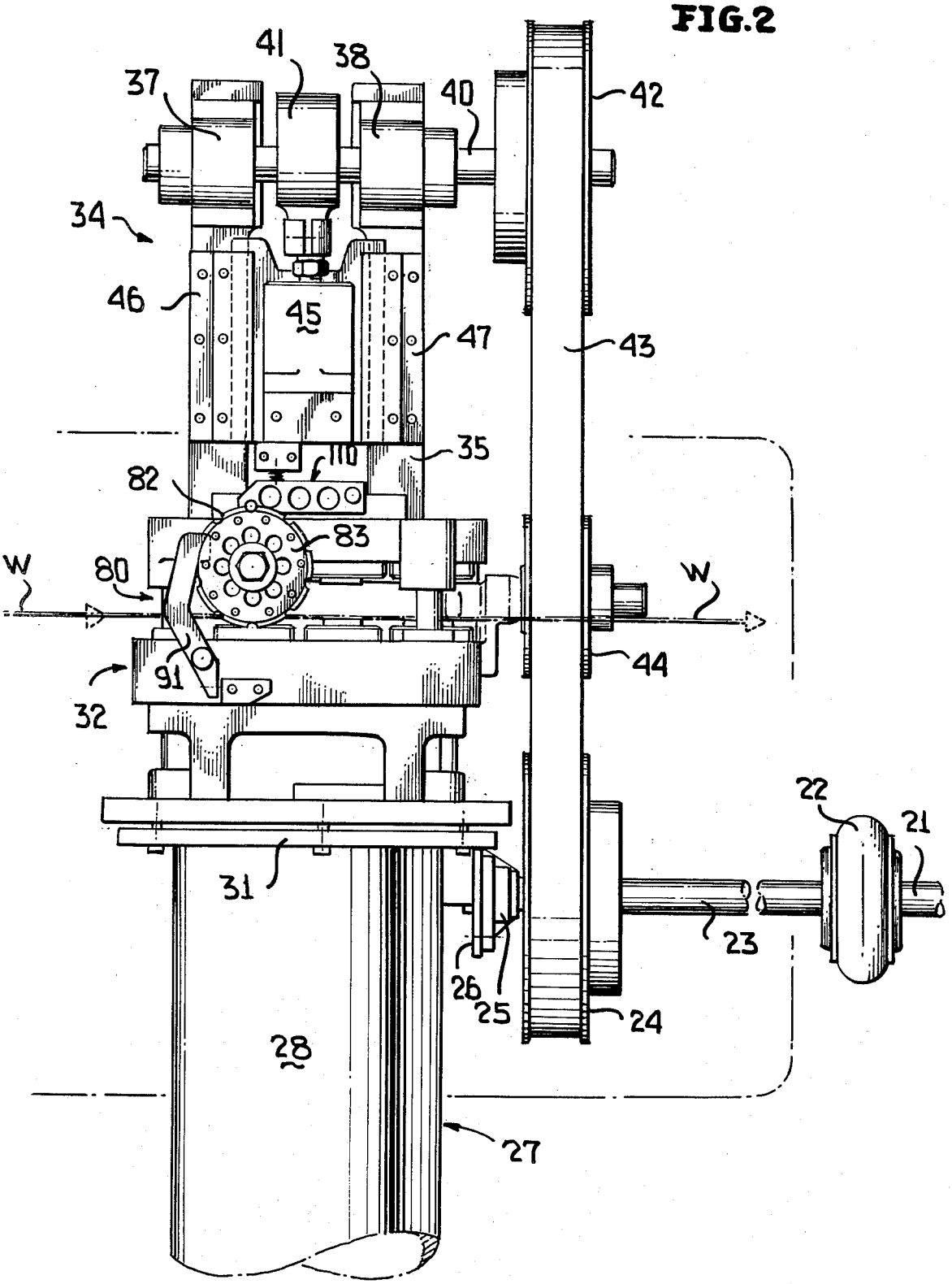
FIG. 2 is an enlarged side elevational view of the embossing machine and indexing mechanism of FIG. 1, and illustrates a take-off drive for the embossing machine, a pair of die elements thereof, an indexing wheel, a pawl, and an indexing detent.
Figure 1:
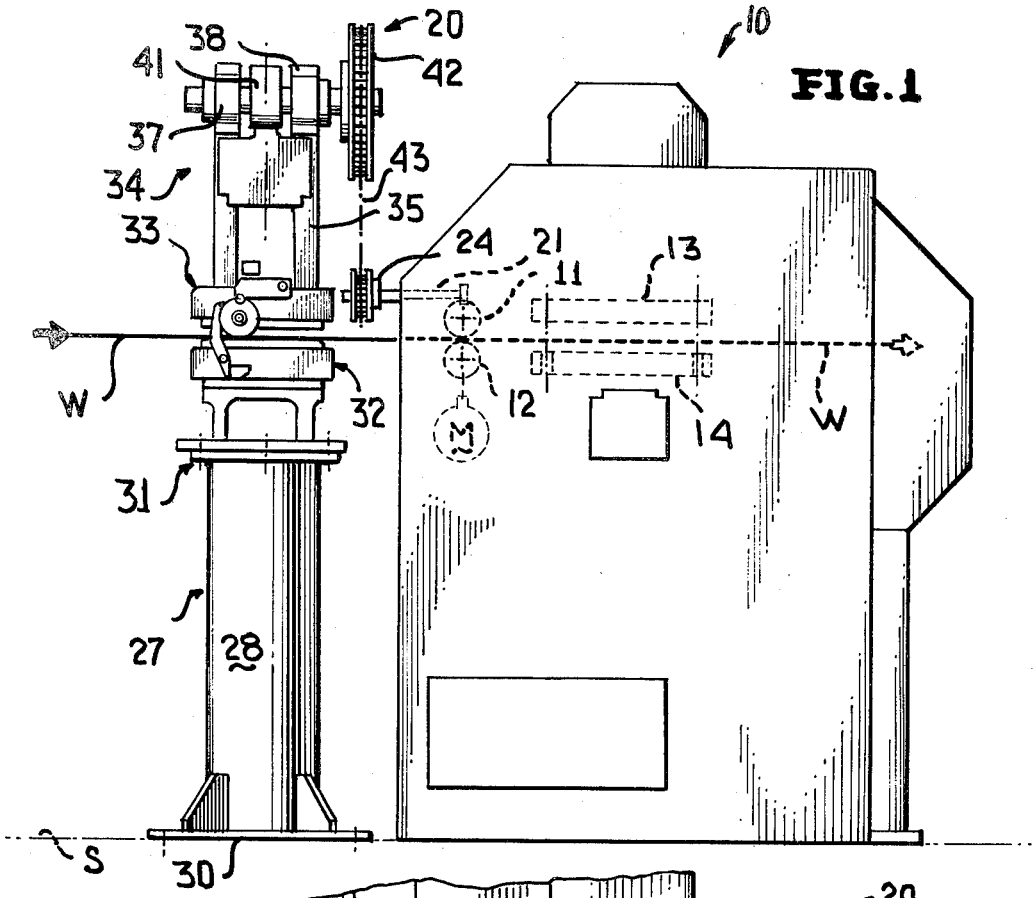
Figure 6:
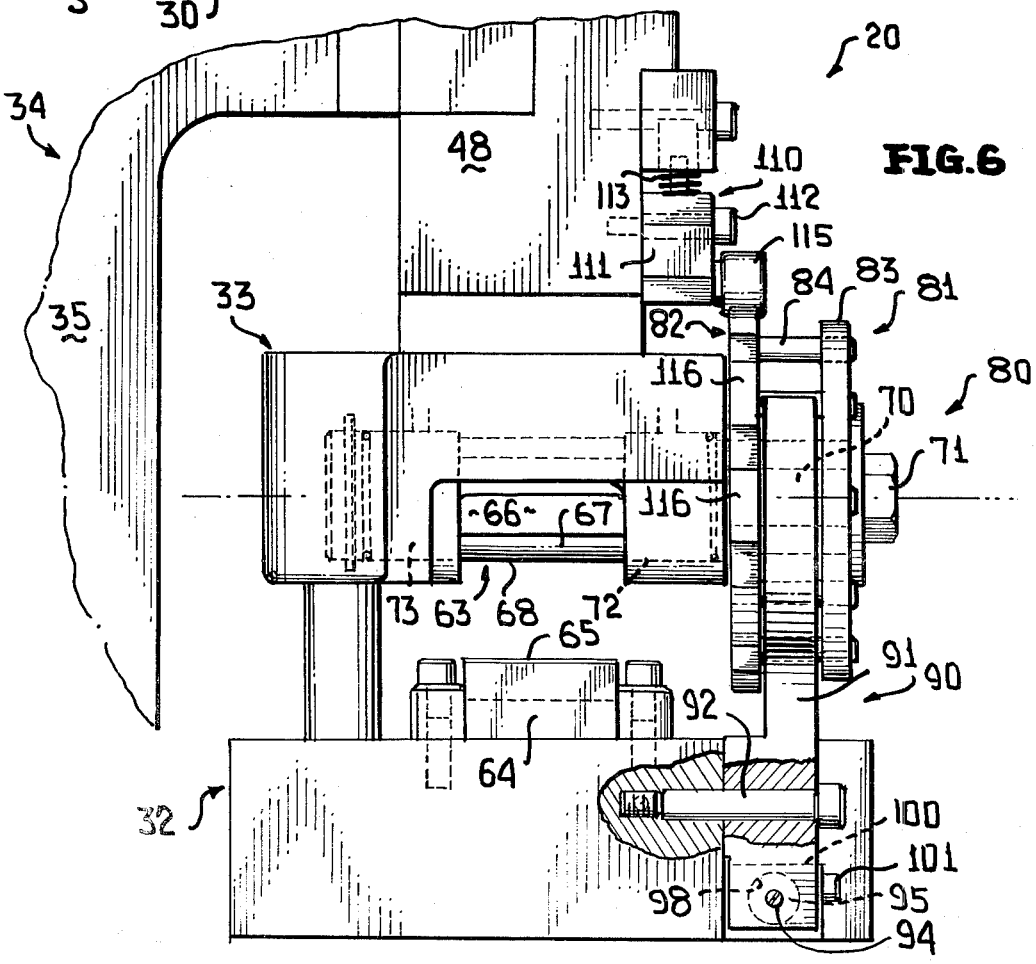

A conventional tab press for manufacturing tabs for beverage ends or can ends is schematically illustrated in FIG. 1 and is generally designated by the reference numeral 10. The tab press 10 is of a conventional construction and includes an appropriate pair of feed rolls 11, 12 driven by conventional means, such as a motor M, to draw a web W of aluminum or like metallic material from left-to-right, as viewed in FIG. 1 between a series of reciprocal tab-forming dies 13, 14. The dies 13, 14 perform sequential operations on the web W as it is advanced in a step-by-step fashion from left-to-right in FIG. 1 until finished tabs (not shown) are totally stamped and removed from the scrap web W exiting the right-hand side (unnumbered) of the press 10. Since the press 10 is conventional, a further description thereof is unnecessary other than to indicate that an output from the drive means M of the feed rollers 11, 12 is utilized to drive an embossing machine 20 of the present invention through a take-off shaft 21 (FIGS. 1 and 2).

The take-off shaft 21 is connected through a conventional flexible coupling 22 to another shaft 23 carrying a toothed synchronized drive pulley 24. The pulley 24 is appropriately keyed to the shaft 23 and an end (unnumbered) of the shaft 23 to the left of the pulley 24 (as viewed in FIG. 2) is journaled for rotation in a bearing (not shown) of a bearing housing 25 carried by a bracket 26 which is in turn welded or otherwise secured to a frame 27 of the embossing machine 20. The frame 27 includes a tubular pedestal 28 and a generally horizontally disposed base plate 30 which rests upon an appropriate supporting surface S.

An upper support plate 31 of the pedestal 28 carries a lower die element 32 which is opposed by an upper die element 33. The die element 32, 33 are reciprocated relative to each other by a conventional "Benchmaster" power press which is generally designated by the reference numeral 34.

The power press 34 includes a head or support 35 fixed to the plate 31 in an appropriate fashion and having secured to a lower surface 36 thereof (FIG. 3) the lower and immovable die element 32. An upper end of the head 35 carries a pair of trunnions or bearings 37, 38 which rotatably journal a crankshaft 40 having a central eccentric 41 (FIG. 2) and whose right-hand end carries a sychronized toothed pulley 42. A toothed timing belt 43 is entrained about the pulleys 24, 42 and an idler toothed pulley 44. The take-off from the shaft 21 therefor drives through the pulley 24, the belt 43, and the pulley 42 the shaft 40 which in turn rotates the eccentric 41 in a conventional manner to reciprocate a crank or slide 45 guided for vertical reciprocal motion in guides 46, 47. The crank 45 has a lower end (unnumbered) which is connected through appropriate fittings 48 to the die element 33. Thus, upon the rotation of the shaft 40, the eccentric 41 reciprocates the crank 45 which in turn reciprocates the upper die element 33 relative to the lower die element 32 between a first generally opened position and a second generally closed position at which embossing of the web W takes place as it is drawn between the die elements 32, 33 from a source (not shown) to the left of the embossing machine, as viewed in FIG. 2.

Figure 5:
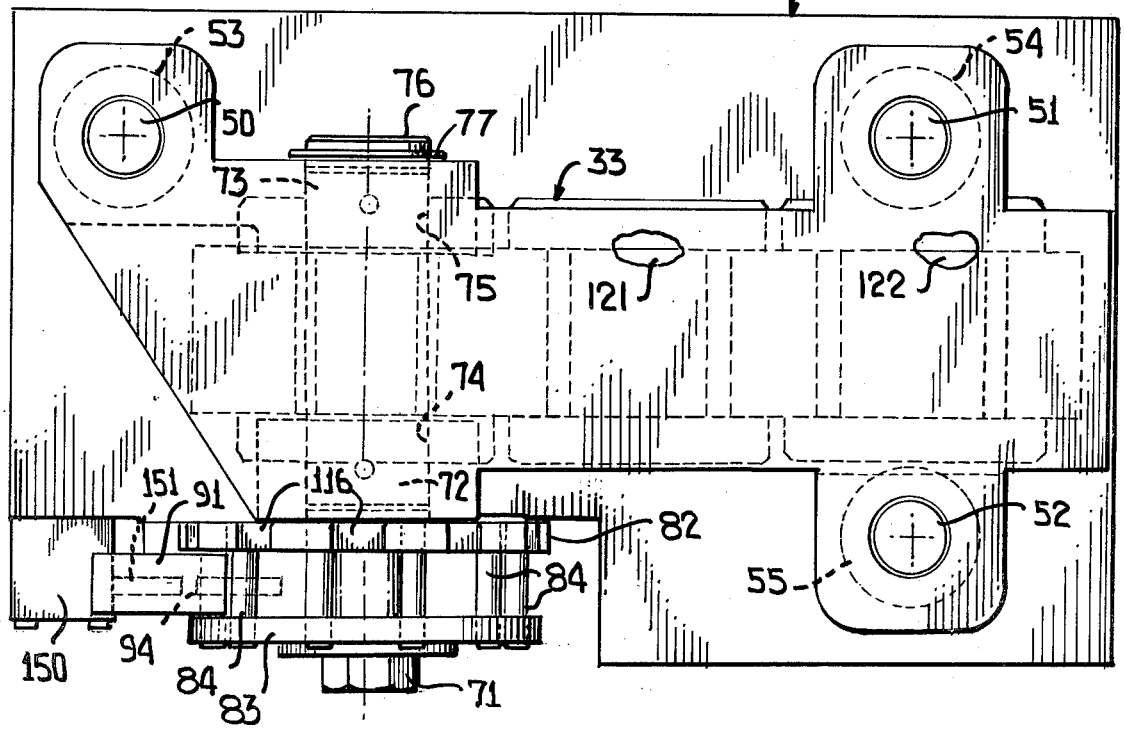
FIG. 5 is a sectional view taken generally along line 5—5 of FIG. 4, and illustrates the manner in which the indexing wheel is connected to a shaft which in turn carries a plurality of embossing stamps.

The die element 33 carries three vertical guide rods 50, 51, 52 which are received in respective sleeved or bushed bores 53 through 55 of the lower die element 32. Thus, as the upper die element 33 is reciprocated by the crank arm or crank 45, it is guided through its reciprocation through the interaction of the conventional guide rods 50 through 52 and the associated bush bores 53 through 55 (FIG. 5).

The die elements 32, 33 carry cooperative means 62, 63 for embossing or printing the tab area of the web W as the same is disposed therebetween when the die elements 32, 33 are moved from their open position (all figures of drawings) to the closed position thereof.

Figure 6:
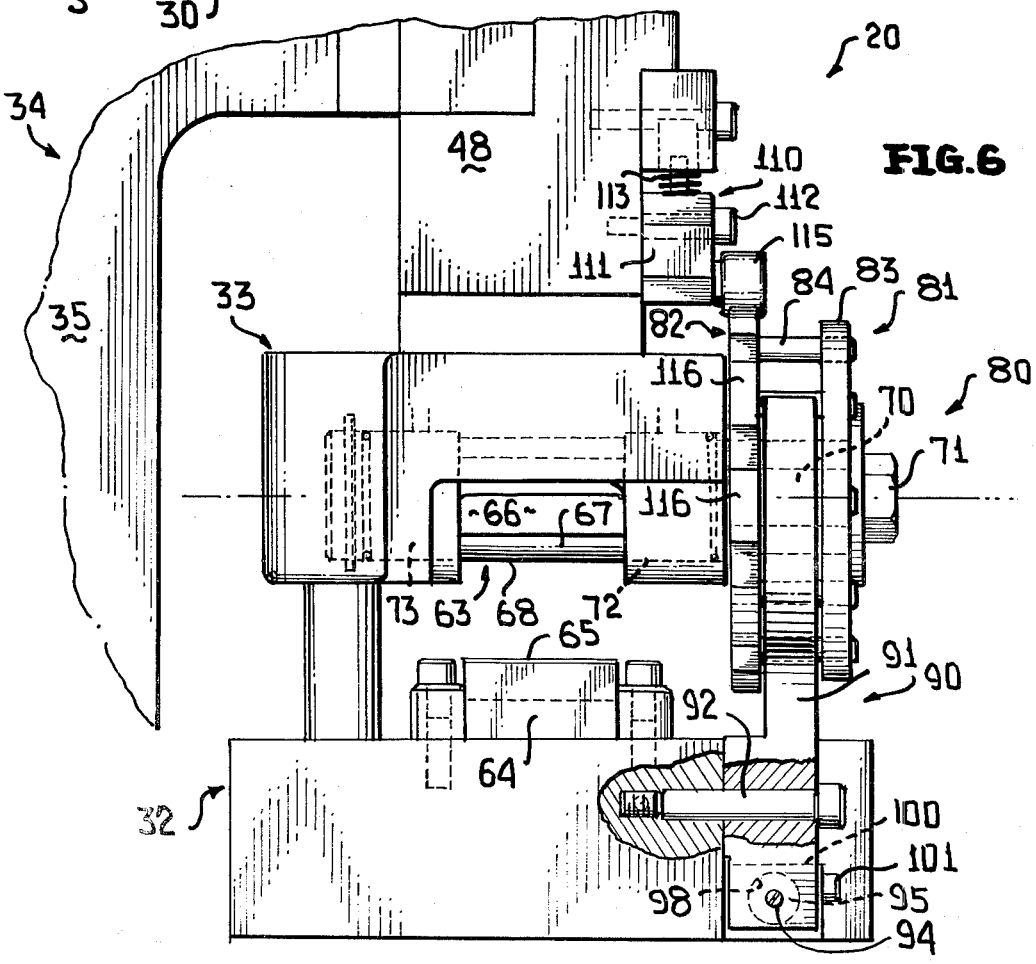
FIG. 6 is an end view looking from left-to-right in FIG. 4, and illustrates the cooperative relationship between an anvil associated with a lowermost of the embossing stamps and the cooperative relationship between the indexing detent, the indexing wheel and the pawl.

The cooperative embossing means 62 is simply an anvil 64 (FIG. 6) conventionally held to the die element 32 and having an upper surface 65 in opposed relationship to the cooperative embossing means 63.

The cooperative embossing means 63 includes ten embossing stamps 66, 67, 68, etc., each having a different code (not shown) with each stamp 66, 67, 68, etc., being conventionally secured to a shaft or bolt 70 having a head 71. The shaft 70 is housed in bearings or trunnions 72, 73 housed in respective bores 74, 75 (FIG. 5) of the upper die element 33. A terminal end 76 of the bolt or shaft 70 opposite the head 71 (FIG. 5) has an appropriate groove (unnumbered) which receives a conventional locking ring 77 which prevents the withdrawal of the shaft 70 from the die element 33. By rotating the shaft 70 in the manner to be described immediately hereinafter through 36 degrees during each indexing, the embossing stamps 66, 67, 68, etc., are likewise rotated successively through 36 degrees bringing each of these stamps successively into a position directly above the anvil 64 such that upon downward motion of the die element 33, the tab area of the web W between, for example, the surface 65 and the embossing stamp 68 is embossed with a code on the latter embossing stamp.

Means generally designated by the reference numeral 80 are provided for indexing the rotatable shaft 70 and the embossing stamp 66, 67, 68, etc., carried thereby during each relative movement of the pair of die elements 32, 33 from their closed second position to the generally open first position to sequentially position the embossing stamps into cooperative relationship with the anvil 64. The indexing means 80 includes an indexing wheel 81 which includes a pair of discs 82, 83 in spaced relationship to each other and having fixed therebetween abutment means in the form of ten pins, each which is generally designated by the reference numeral 84. Suitable means, such as a key and keyway (not shown) are used to fix the discs 82, 83 to the shaft or bolt 70. Thus, rotation imparted to the indexing wheel 81 will likewise rotate the shaft or bolt 70 and, thus, will also rotate the embossing stamps 66, 67, 68, etc.

Figure 4:
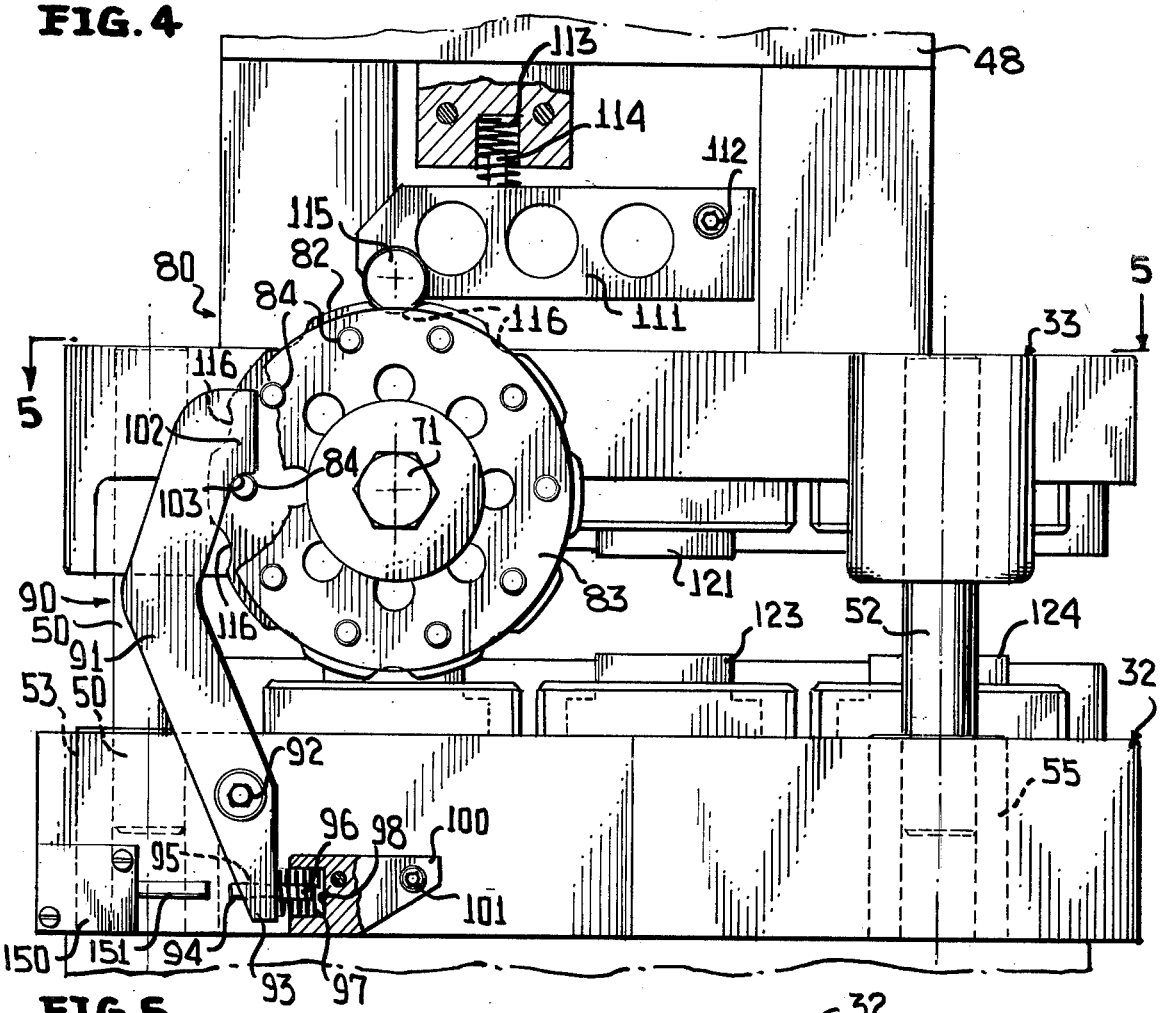
FIG. 4 is an enlarged elevational view of the die elements, and illustrate the manner in which the upper die element carries the indexing wheel and an arm for the indexing detent while the lower die element carries the spring-biased pawl.

Means generally designated by the reference numeral 90 (FIGS. 4 and 6) are provided for rotating the indexing wheel 81 of the indexing means 80 in response to relative movement of the pair of die elements 32, 33 away from each other or toward the open position thereof. The indexing wheel rotating means 90 includes a pawl 91 mounted for pivotal movement by a pivot pin 92 to the lower die element 32. A lower terminal end portion 93 of the pawl 91 carries a threaded adjusting screw 94 received in a threaded bore 95 of the pawl 91. An end 96 (FIG. 4) of the threaded adjusting screw 94 is surrounded by a coil spring 97 housed in a cylindrical blind bore 98 of a block 100 fixed by bolts 101 to the die element 32. The spring 97 normally urges the pawl 91 in a clockwise direction about the pivot pin 92 to normally urge an upper end 102 of the pawl 91, including a shoulder or radius 103 thereof, into overlying abutting contact with successive ones of the pins 84, as is illustrated by the pin 84 in the 9 o'clock position of the indexing wheel 81 of FIG. 4. As will be most readily appreciated from FIG. 4, upon upward movement of the die element 33, the indexing wheel 81 will be rotated in a counterclockwise direction due to the interaction of the shoulder or radius 103 of the pawl 91 and its contact with the pin 84 at the 9 o'clock position. The rotation of the indexing wheel 81 is such that the indexing wheel 81 will be rotated 36 degrees during the movement of the die element 33 from the position shown in FIG. 4 to its uppermost position after which the die element 33 will simply descend and the next of the embossing stamps 66, 67, 68, etc., in opposed relationship to the anvil 64 will be positioned to imprint its code upon the next succeeding tab area of the web W. The latter operation is, of course, continued in a successive manner during the reciprocation of the die element 33 relative to the die element 32.

The indexing means 80 further includes means 110 normally, though releasably, holding the index wheel in each of its ten distinct positions. The holding means 110 includes an arm 111 pivoted by a pivot pin 112 to the fittings 48 with the arm 111 being normally biased by a spring 113 encapsulating a locating pin 114 in the manner best illustrated in FIGS. 4 and 6 of the drawings. The arm 111 carries an indexing detent or roller 115 which engages in one of ten outwardly opening recesses or grooves 116 in the periphery (unnumbered) of the disc 82 of the indexing wheel 81. Thus, the detent 115 when in any one of the recesses or slots 116 will prevent the indexing wheel 81 from rotating and, therefore, will hold the shaft 70 and the embossing stamps 66, 67, 68, etc., in the particular position relative to the anvil 64. However, during the opening or upward movement of the die element 33 latter-described the pawl 91 moves the indexing wheel 81 in a counterclockwise direction, the same movement of the disc 82 forces the indexing detent 115 upwardly and outwardly of its associated slot 116 which in turn pivots the arm 111 clockwise, as viewed in FIG. 2, against the biasing force of the spring 113. However, at such time as the indexing wheel 81 approaches 36 degrees movement, the spring 113 urges the arm 111 in a counterclockwise direction and the indexing detent 115 seats in the next succeeding slot 116, thus holding the indexing wheel 81 in a position at which the next succeeding embossing stamp 66, 67, 68, etc. will be aligned with the anvil 64 during the descent of the die element 33. In this fashion, the indexing wheel 81 is progressively rotated by the pawl 91 through 36 degrees as the die element 33 is raised or opened releasing the detent 115 from its associated slot 116, while at the end of the upward motion of the die element 33, the detent 115 seats in the next succeeding slot 116 and, thus, locks the indexing wheel and its associated stamps 66, 67, 68, etc., for the next embossing operation as the die element 33 next descends toward the anvil 64. The latter is repeated continuously as the web W is indexed from left-to-right in FIG. 4 at a rate commensurate with the operation of the tab press 10 (approximately 400 strokes per minute).

Additional dies 121, 122 (FIGS. 4 and 5) may be carried by the upper die elements 33 in aligned relationship with respective anvils 123, 124, although these dies and anvils form no particular part of the present invention. The die 121 and anvil 123 may be, for example, a so-called camouflaging die which overprints on the code formed by the embossing stamps 66, 67, 68, etc., in order that one may not simply bend one of the tabs upwardly when attached to a can end and determine whether or not a winning code is embossed thereon. Likewise, the die 122 may be used simply to print additional indicia atop the tab, as opposed to underside embossing which is effected by the embossing stamps 66, 67, 68, etc.

Although only a preferred embodiment of the invention has been specifically illustrated and described herein, it is to be understood that minor variations may be made in the apparatus without departing from the spirit and scope of the invention, as defined in the appended claims. Electrical solenoid 150 upon energization will extend rod 151 to the right contacting screw 151. This will cause index pawl 91 to pivot counter clockwise upon pivot pin 92 effectively preventing engagement of the pawl 10 and pins reference 84. An electronic counter not shown can be set to trigger electrical solenoid 150 for a predetermined number of strokes. Thus allowing the same code to be imprinted more than once when desirable.

What is claimed is:

1. An embossing machine comprising a pair of die elements, means for relatively reciprocating said pair of die elements to move the same between a first generally open position and a second generally closed position, first and second of said pair of die elements carrying respective first and second cooperative means for embossing an article disposed therebetween upon the relative movement of said pair of die elements from said first generally open position toward said second generally closed position, said first of said pair of die elements carrying a rotatable shaft, said first cooperative embossing means being a plurality of embossing stamps carried by said rotatable shaft, means for indexing said rotatable shaft during each relative movement of said pair of die elements from said second position toward said first position to sequentially position the embossing stamps into cooperative relationship with the said second embossing means whereby upon each relative movement of said pair of die elements from said first generally open position to said second generally closed position an article is embossed therebetween, said indexing means including an indexing wheel carried by said rotatable shaft, means carried by said first die element for normally though releasably holding said indexing wheel in one of a plurality of distinct positions, means carried by said second die element for rotating said indexing wheel in response to relative movement of said pair of die elements toward said first generally open position thereof to position successive ones of said embossing stamps into said cooperative relationship with the other of said first and second embossing means, and said indexing wheel rotating means is positioned in spanning relationship to a plane generally common to said first and second cooperative embossing means in said second generally closed position.

2. The embossing machine as defined in claim 1 wherein said indexing wheel rotating means includes a pawl.

3. The embossing machine as defined in claim 2 wherein said indexing wheel holding means includes an indexing detent movable into and out of holding engagement with said indexing wheel, and means for biasing said indexing detent into holding engagement with said indexing wheel.

4. The embossing machine as defined in claim 2 wherein said indexing wheel holding means includes an indexing detent movable into and out of holding engagement with said indexing wheel, and means for spring-biasing said indexing detent into holding engagement with said indexing wheel.

5. The embossing machine as defined in claim 2 wherein said indexing wheel holding means includes an indexing detent movable into and out of holding engagement with said indexing wheel, a pivotally mounted arm carrying said indexing detent, and means for biasing said pivotally mounted arm for movement in a direction to urge said indexing detent into holding engagement with said indexing wheel.

6. The embossing machine as defined in claim 2 wherein said indexing wheel holding means includes an indexing detent movable into and out of holding engagement with said indexing wheel, a pivotally mounted arm carrying said indexing detent, and means for spring-biasing said pivotally mounted arm for movement in a direction to urge said indexing detent into holding engagement with said indexing wheel.

7. The embossing machine as defined in claim 2 wherein said indexing wheel holding means includes an indexing detent movable into and out of holding engagement with said indexing wheel, and said indexing wheel includes a plurality of angularly spaced recesses adapted to successively receive said indexing detent.

8. The embossing machine as defined in claim 2 wherein said indexing wheel holding means includes an indexing detent movable into and out of holding engagement with said indexing wheel, said indexing wheel includes a plurality of angularly spaced recesses adapted to successively receive said indexing detent, and means for biasing said indexing detent into holding engagement with successive ones of said recesses.

9. The embossing machine as defined in claim 2 wherein said indexing wheel holding means includes an indexing detent movable into and out of holding engagement with said indexing wheel, said indexing wheel includes a plurality of angularly spaced recesses adapted to successively receive said indexing detent, and means for spring-biasing said indexing detent into holding engagement with successive ones of said recesses.

10. The embossing machine as defined n claim 2 wherein said indexing wheel holding means includes an indexing detent movable into and out of holding engagement with said indexing wheel, said indexing wheel includes a plurality of angularly spaced recesses adapted to successively receive said indexing detent, a pivotally mounted arm carrying said indexing detent, and means for biasing said pivotally mounted arm for movement in a direction to urge said indexing detent into holding engagement with successive ones of said recesses.

11. The embossing machine as defined in claim 1 wherein said indexing wheel holding means includes an indexing detent movable into and out of holding engagement with said indexing wheel.

12. The embossing machine as defined in claim 1 wherein said indexing wheel rotating means includes a pivotally mounted pawl.

13. The embossing machine as defined in claim 12 wherein said indexing wheel holding means includes an indexing detent movable into and out of holding engagement with said indexing wheel, a pivotally mounted arm carrying said indexing detent, and means for biasing said pivotally mounted arm for movement in a direction to urge said indexing detent into holding engagement with said indexing wheel.

14. The embossing machine as defined in claim 12 wherein said indexing wheel holding means includes an indexing detent movable into and out of holding engagement with said indexing wheel, said indexing wheel includes a plurality of angularly spaced recesses adapted to successively receive said indexing detent, and means for biasing said indexing detent into holding engagement with successive ones of said recesses.

15. The embossing machine as defined in claim 12 wherein said indexing wheel holding means includes an indexing detent movable into and out of holding engagement with said indexing wheel, said indexing wheel includes a plurality of angularly spaced recesses adapted to successively receive said indexing detent, a pivotally mounted arm carrying said indexing detent, and means for biasing said pivotally mounted arm for movement in a direction to urge said indexing detent into holding engagement with successive ones of said recesses.

16. The embossing machine as defined in claim 1 wherein said indexing wheel rotating means includes a pawl, and a plurality of angularly spaced abutment means carried by said indexing wheel for individually and successively engaging said pawl at least during the relative movement of said pair of die elements toward said first generally open position.

17. The embossing machine as defined in claim 16 wherein said indexing wheel holding means includes an indexing detent movable into and out of holding engagement with said indexing wheel, a pivotally mounted arm carrying said indexing detent, and means for biasing said pivotally mounted arm for movement in a direction to urge said indexing detent into holding engagement with said indexing wheel.

18. The embossing machine as defined in claim 16 wherein said indexing wheel holding means includes an indexing detent movable into and out of holding engagement with said indexing wheel, said indexing wheel includes a plurality of angularly spaced recesses adapted to successively receive said indexing detent, and means for biasing said indexing detent into holding engagement with successive ones of said recesses.

19. The embossing meachine as defined in claim 16 wherein said indexing wheel holding means includes an indexing detent movable into and out of holding engagement with said indexing wheel, said indexing wheel includes a plurality of angularly spaced recesses adapted to successively receive said indexing detent, a pivotally mounted arm carrying said indexing detent, and means for biasing said pivotally mounted arm for movement in a direction to urge said indexing detent into holding engagement with successive ones of said recesses.

20. The embossing machine as defined in claim 1 wherein said indexing wheel rotating means includes a pawl, a plurality of angularly spaced abutment means carried by said indexing wheel for individually and successively engaging said pawl at least during the relative movement of said pair of die elements toward said first generally open position, and means for biasing said pawl into engagement with said abutment means.

21. The embossing machine as defined in claim 20 wherein said indexing wheel holding means includes an indexing detent movable into and out of holding engagement with said indexing wheel, a pivotally mounted arm carrying said indexing detent, and means for biasing said pivotally mounted arm for movement in a direction to urge said indexing detent into holding engagement with said indexing wheel.

22. The embossing machine as defined in claim 20 wherein said indexing wheel holding means includes an indexing detent movable into and out of holding engagement with said indexing wheel, said indexing wheel includes a plurality of angularly spaced recesses adapted to successively receive said indexing detent, and means for biasing said indexing detent into holding engagement with successive ones of said recesses.

23. The embossing machine as defined in claim 20 wherein said indexing wheel holding means includes an indexing detent movable into and out of holding engagement with said indexing wheel, said indexing wheel includes a plurality of angularly spaced recesses adapted to successively receive said indexing detent, a pivotally mounted arm carrying said indexing detent, and means for biasing said pivotally mounted arm for movement in a direction to urge said indexing detent into holding engagement with successive ones of said recesses.

24. The embossing machine as defined in claim 1 wherein said indexing wheel rotating means includes a pivoted pawl, a plurality of angularly spaced abutment means carried by said indexing wheel for individually and successively engaging said pivoted pawl at least during the relative movement of said pair of die elements toward said first generally open position, and means for biasing said pivoted pawl into engagement with said abutment means.

25. The embossing machine as defined in claim 1 wherein said indexing wheel rotating means includes a pawl, a plurality of angularly spaced abutment means carried by said indexing wheel for individually and successively engaging said pawl at least during the relative movement of said pair of die elements toward said first generally open position, and means for spring-biasing said pawl into engagement with said abutment means.

26. The embossing machine as defined in claim 1 wherein said indexing wheel rotating means includes a pivoted pawl, a plurality of angularly spaced abutment means carried by said indexing wheel for individually and successively engaging said pivoted pawl at least during the relative movement of said pair of die elements toward said first generally open position, and means for spring-biasing said pivoted pawl into engagement with said abutment means.

27. The embossing machine as defined in claim 1 wherein said indexing wheel holding means includes an indexing detent movable into and out of holding engagement with said indexing wheel, and means for biasing said indexing detent into holding engagement with said indexing wheel.

28. The embossing machine as defined in claim 1 wherein said indexing wheel holding means includes an indexing detent movable into and out of holding engagement with said indexing wheel, and means for spring-biasing said indexing detent into holding engagement with said indexing wheel.

29. The embossing machine as defined in claim 1 wherein said indexing wheel holding means includes an indexing detent movable into and out of holding engagement with said indexing wheel, a pivotally mounted arm carrying said indexing detent, and means for biasing said pivotally mounted arm for movement in a direction to urge said indexing detent into holding engagement with said indexing wheel.

30. The embossing machine as defined in claim 1 wherein said indexing wheel holding means includes an indexing detent movable into and out of holding engagement with said indexing wheel, a pivotally mounted arm carrying said indexing detent, and means for spring-biasing said pivotally mounted arm for movement in a direction to urge said indexing detent into holding engagement with said indexing wheel.

31. The embossing machine as defined in claim 1 wherein said indexing wheel holding means includes an indexing detent movable into and out of holding engagement with said indexing wheel, and said indexing wheel includes a plurality of angularly spaced recesses adapted to successively receive said indexing detent.

32. The embossing machine as defined in claim 1 wherein said indexing wheel holding means includes an indexing detent movable into and out of holding engagement with said indexing wheel, said indexing wheel includes a plurality of angularly spaced recesses adapted to successively receive said indexing detent, and means for biasing said indexing detent into holding engagement with successive ones of said recesses.

33. The embossing machine as defined in claim 1 wherein said indexing wheel holding means includes an indexing detent movable into and out of holding engagement with said indexing wheel, said indexing wheel includes a plurality of angularly spaced recesses adapted to successively receive said indexing detent, and means for spring-biasing said indexing detent into holding engagement with successive ones of said recesses.

34. The embossing machine as defined in claim 1 wherein said indexing wheel holding means includes an indexing detent movable into and out of holding engagement with said indexing wheel, said indexing wheel includes a plurality of angularly spaced recesses adapted to successively receive said indexing detent, a pivotally mounted arm carrying said indexing detent, and means for biasing said pivotally mounted arm for movement in a direction to urge said indexing detent into holding engagement with successive ones of said recesses.

35. The embossing machine as defined in claim 1 wherein said indexing wheel holding means includes an indexing detent movable into and out of holding engagement with said indexing wheel, said indexing wheel includes at least one disc having a peripheral portion, a plurality of angularly spaced recesses adapted to successively receive said indexing detent, a pivotally mounted arm carrying said indexing detent, and means for biasing said pivotally mounted arm for movement in a direction to urge said indexing detent into holding engagement with successive ones of said recesses.

36. The embossing machine as defined in claim 1 wherein said indexing wheel rotating means includes a pawl, means for pivotally connecting said pawl to said second die element, said pawl having opposite first and second end portions, said pawl second end portion being pivotally connected by said pivotally connecting means to said second die element, and said pawl first end portion terminating in a nose for selectively individually engaging each of a plurality of angularly spaced abutment means carried by said indexing wheel for rotating said indexing wheel during the relative movement of said pair of die elements toward said first generally open position.

37. The embossing machine as defined in claim 36 including means for preventing the operation of said indexing wheel rotating means for at least one reciprocal movement between said pair of die elements thereby duplicating the embossing upon two successive articles positioned between said embossing means, and said operation preventing means operates through said pawl second end portion to pivot said pawl to a position at which said nose cannot engage said abutment means.

38. The embossing machine as defined in claim 37 wherein said indexing wheel holding means includes an indexing detent movable into and out of holding engagement with said indexing wheel, a pivotally mounted arm carrying said indexing detent, and means for spring-biasing said pivotally mounted arm for movement in a direction to urge said indexing detent into holding engagement with said indexing wheel.

39. The embossing machine as defined in claim 36 wherein said indexing wheel holding means includes an indexing detent movable into and out of holding engagement with said indexing wheel, a pivotally mounted arm carrying said indexing detent, and means for spring-biasing said pivotally mounted arm for movement in a direction to urge said indexing detent into holding engagement with said indexing wheel.

40. The embossing machine as defined in claim 1 including means for preventing the operation of said indexing wheel rotating means for at least one reciprocal movement between said pair of die elements thereby duplicating the embossing upon two successive articles positioned between said embossing means.

41. The embossing machine as defined in claim 40 wherein said indexing wheel holding means includes an indexing detent movable into and out of holding engagement with said indexing wheel, a pivotally mounted arm carrying said indexing detent, and means for spring-biasing said pivotally mounted arm for movement in a direction to urge said indexing detent into holding engagement with said indexing wheel.

* * * * *